US010488787B2

(12) United States Patent
Okamura et al.

(10) Patent No.: US 10,488,787 B2
(45) Date of Patent: Nov. 26, 2019

(54) REMAINING POWDER AMOUNT DETECTION DEVICE, IMAGE FORMING DEVICE, AND REMAINING POWDER AMOUNT DETECTION METHOD

(71) Applicant: Ricoh Company, Ltd., Tokyo (JP)

(72) Inventors: Hiroshi Okamura, Kanagawa (JP); Masaki Tsugawa, Kanagawa (JP); Yuji Ikeda, Kanagawa (JP); Natsuko Ishizuka, Kanagawa (JP); Hayato Fujita, Kanagawa (JP); Yohei Kushida, Kanagawa (JP); Keita Maejima, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/988,087

(22) Filed: May 24, 2018

(65) Prior Publication Data

US 2018/0348664 A1 Dec. 6, 2018

(30) Foreign Application Priority Data

May 31, 2017 (JP) ..... 2017-108167

(51) Int. Cl.
*G03G 15/08* (2006.01)

(52) U.S. Cl.
CPC ..... *G03G 15/086* (2013.01); *G03G 15/0856* (2013.01); *G03G 2215/0888* (2013.01)

(58) Field of Classification Search
CPC .. G03G 15/086; G03G 15/056; G03G 15/085; G03G 2215/0888; G03G 15/0856; G03G 15/0858
See application file for complete search history.

(56) References Cited

U.S. PATENT DOCUMENTS

2012/0195611 A1 8/2012 Adachi et al.

FOREIGN PATENT DOCUMENTS

| | | |
|---|---|---|
| JP | 09-062147 | 3/1997 |
| JP | 2004-286793 | 10/2004 |
| JP | 2008-058615 | 3/2008 |
| JP | 2011-158882 | 8/2011 |

OTHER PUBLICATIONS

English Translation of JP2004286793; Shiroichi et al. Published Oct. 14, 2004 (Year: 2004).*

* cited by examiner

*Primary Examiner* — Ryan D Walsh
(74) *Attorney, Agent, or Firm* — Xsensus LLP

(57) ABSTRACT

A remaining powder amount detection device includes: a powder moving portion configured to change a distribution of powder in an inner space of a powder container containing the powder; a drive unit configured to drive the powder moving portion; a change value detector configured to detect a change value indicating a positional change of the powder container; and a remaining powder amount detector configured to detect a remaining amount of the powder contained in the powder container, based on the change value. The drive unit is configured to drive the powder moving portion so as to move the powder to near the change value detector. The remaining powder amount detector is configured to detect the remaining amount based on the change value in a state where the powder is moved to near the change value detector.

13 Claims, 12 Drawing Sheets

A: STRAIN SENSOR OUTPUT CHARACTERISTICS FOR TONER DISTRIBUTION IN FIG. 9
B: STRAIN SENSOR OUTPUT CHARACTERISTICS FOR TONER DISTRIBUTION IN FIG. 10

C: REMAINING AMOUNT OF TONER BASED ON OUTPUT VALUE OF STRAIN SENSOR
D: PREDICTION VALUE OF REMAINING AMOUNT OF TONER BASED ON COUNT OF NUMBER OF PIXELS
E: MINIMUM OF RANGE OF PREDICTION VALUE OF REMAINING AMOUNT OF TONER BASED ON COUNT OF NUMBER OF PIXELS
F: MAXIMUM OF RANGE OF PREDICTION VALUE OF REMAINING AMOUNT OF TONER BASED ON COUNT OF NUMBER OF PIXELS

REMAINING POWDER AMOUNT DETECTION DEVICE, IMAGE FORMING DEVICE, AND REMAINING POWDER AMOUNT DETECTION METHOD

CROSS-REFERENCE TO RELATED APPLICATIONS

The present application claims priority under 35 U.S.C. § 119 to Japanese Patent Application No. 2017-108167, filed on May 31, 2017. The contents of which are incorporated herein by reference in their entirety.

BACKGROUND OF THE INVENTION

1. Field of the Invention

The present invention relates to a remaining powder amount detection device, an image forming device, and a remaining powder amount detection method.

2. Description of the Related Art

An image forming device of an electrophotography type rotates a container filled with powder such as toner to supply the powder to a developing device for developing an electrostatic latent image on a photoconductor. Moreover, detection is performed regarding the remaining amount of powder in the container, and a user is notified of the detection result and is urged to perform replacement with a container filled with a sufficient amount of powder.

To detect the remaining amount of powder in a container, there is a technique of detecting a weight of the entire container, and of calculating the remaining amount of powder in the container based on the detected weight (for example, see Japanese Unexamined Patent Application Publication No. 2004-286793). According to Japanese Unexamined Patent Application Publication No. 2004-286793, an amount of displacement of an elastic body, such as a spring, supporting the container is measured by a variable resistor or a photo sensor, and the remaining amount of powder is detected based on the measured amount of displacement.

As described above, an image forming device rotates a container to supply powder to a developing device, and thus, a distribution situation of the powder in the container is changed. In such a case, Japanese Unexamined Patent Application Publication No. 2004-286793 cannot accurately detect the remaining amount of powder in the container, because a relationship between the amount of displacement of the elastic body and the remaining amount of powder is not constant due to variation of the distribution situation of the powder.

SUMMARY OF THE INVENTION

According to one aspect of the present invention, a remaining powder amount detection device includes a powder moving portion, a drive unit, a change value detector, and a remaining powder amount detector. The powder moving portion is configured to change a distribution of powder in an inner space of a powder container containing the powder. The drive unit is configured to drive the powder moving portion. The change value detector is configured to detect a change value indicating a positional change of the powder container. The remaining powder amount detector is configured to detect a remaining amount of the powder contained in the powder container, based on the change value. The drive unit is configured to drive the powder moving portion so as to move the powder to near the change value detector. The remaining powder amount detector is configured to detect the remaining amount based on the change value in a state where the powder is moved to near the change value detector.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
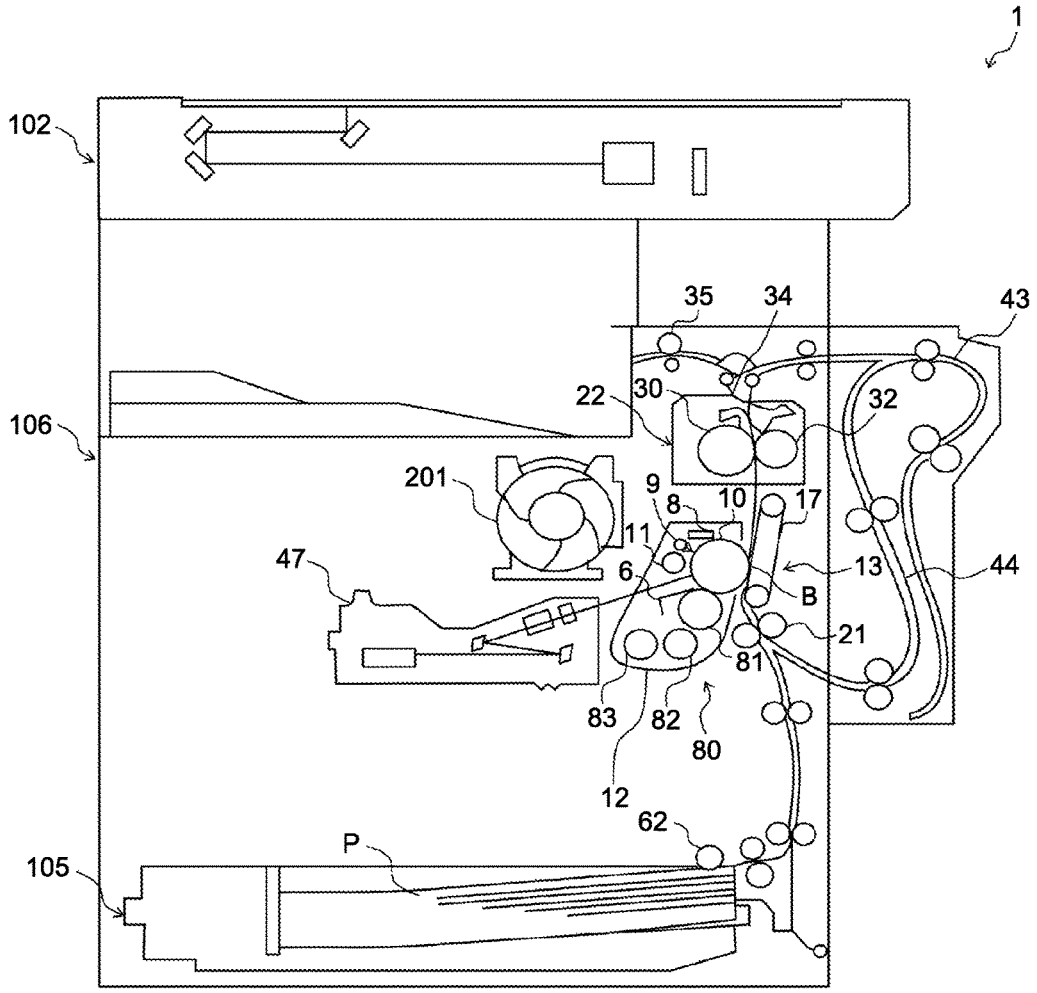
FIG. 1 is a schematic configuration view of an image forming device according to an embodiment of the present invention.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment has an object to accurately detect the remaining amount of powder in a container.

Hereinafter, an embodiment of the present invention will be described with reference to the drawings. In the present embodiment, a description is given of a remaining powder amount detection method, performed by an image forming device that performs image formation/output by an electrophotography method, for detecting a remaining amount of toner in a toner bottle which supplies toner, which is a powder developer, to a developing device that develops an electrostatic latent image formed on a photoconductor. Furthermore, the present embodiment cites a monochrome device as an example of an image forming device 1, but the present invention can be similarly applied to an image forming device which performs color printing using toners of colors of cyan (C), magenta (M), yellow (Y), and black (K).

Figure 2:
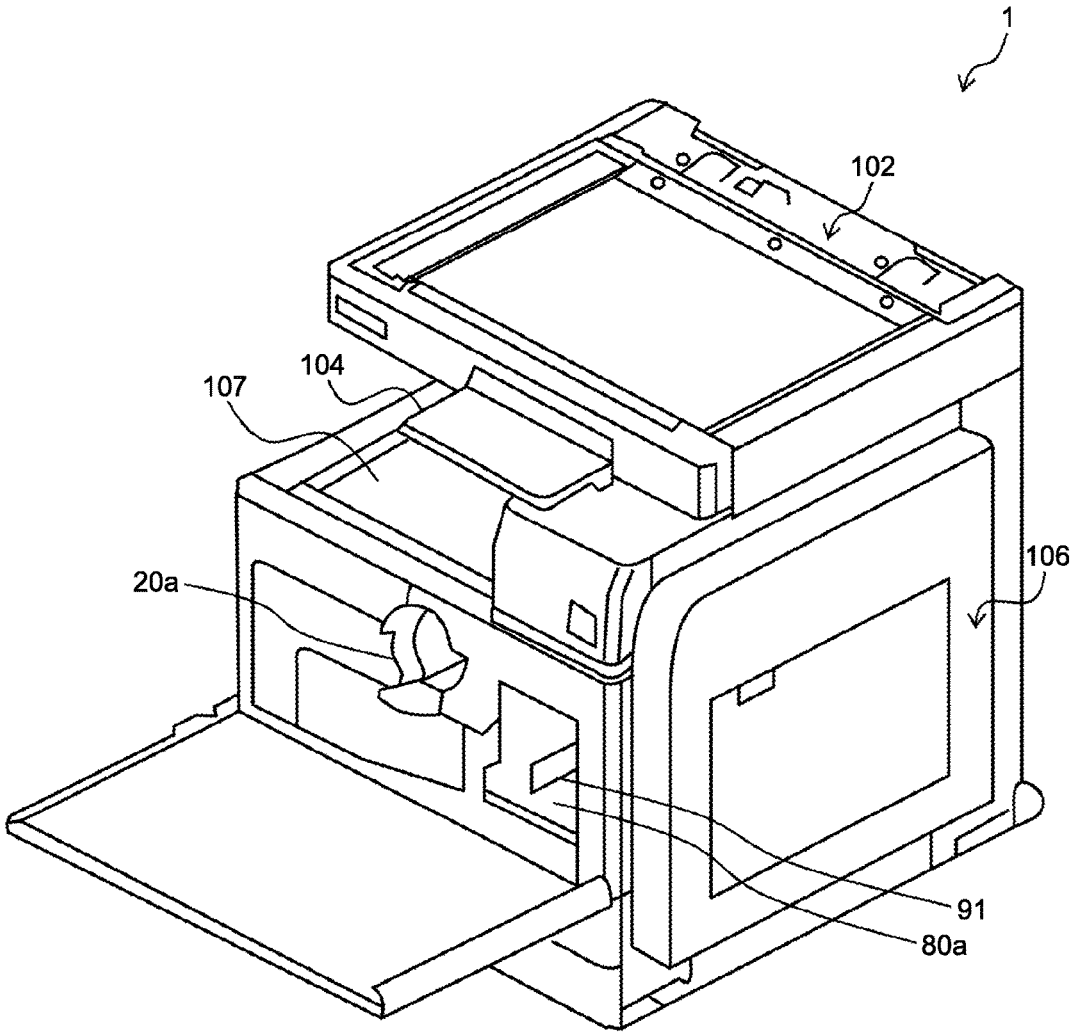
FIG. 2 is a schematic configuration view of the image forming device according to the embodiment of the present invention.

FIGS. 1 and 2 are views illustrating a schematic configuration of the image forming device 1 according to the present embodiment. The image forming device 1 includes a paper feeding table 105, a print engine 106 as an image forming unit, a scanner unit 102 that reads a document, and a display panel 104. A print medium P, such as paper or an OHP film, is stored in the paper feeding table 105. The print medium P is fed by a pickup roller 62, and is then conveyed to the print engine 106.

The print engine 106 functions as an image forming unit including a photoconductor 10 as an image bearer or a latent image bearer, a writing device 47, a charging device 11, a developing device 12, a transferring device 13, a cleaning device 14, and a fixing device 22. The charging device 11 uniformly charges a surface of the photoconductor 10 being rotated. The writing device 47 irradiates the photoconductor 10 with laser light, and forms an electrostatic latent image on the surface of the photoconductor 10.

The developing device 12 causes toner to adhere to the surface of the photoconductor 10 by a developing roller 81, and makes the electrostatic latent image formed on the surface of the photoconductor 10 into a visible image. The transferring device 13 includes a transfer belt 17, and the transfer belt 17 is pressed against a circumferential surface of the photoconductor 10 at a transfer position B.

The print medium P which has passed through registration rollers 21 is sent to the transfer position B. A toner image on the photoconductor 10 is transferred by the transferring device 13 to the print medium P sent to the transfer position B, and the toner image is borne on a surface of the print medium P. The cleaning device 14 removes residual toner on the surface of the photoconductor 10 after the transfer, and residual potential on the photoconductor 10 is removed by a discharging lamp 9.

The fixing device 22 includes a heating roller 30 and a pressure roller 32, and applies heat and pressure to the print medium P bearing the toner image to fix the toner image on the print medium P. Then, the print medium P is ejected and stacked on a paper ejection tray 107 by a paper ejection roller 35.

On the other hand, when forming an image on both surfaces of the print medium P, the print medium P is conveyed to a reversing path 43 by an ejection separator 34. Then, the print medium P is conveyed to the registration rollers 21 through a re-conveying path 44 by reverse rotation of a conveying roller 66. Then, the toner image is transferred in the manner described above to a surface of the print medium P where the toner image is not borne.

As illustrated in FIG. 1, with the image forming device 1, the photoconductor 10, the charging device 11, the developing device 12, and the cleaning device 14 are integrally formed as a process cartridge 80. The developing device 12 includes the developing roller 81, a doctor blade 6 for controlling a thickness of a layer of developer including toner, and screws 82, 83 for stirring and conveying the developer. The cleaning device 14 includes a cleaning blade 8. The discharging lamp 9 removes the residual potential on the photoconductor 10 after the surface of the photoconductor is cleaned by the cleaning blade 8.

The process cartridge 80 can be removed from an opening portion 80*a* by being slid to a front side of the device along a rail 91 extending in a front-back direction of the image forming device 1.

Figure 4:
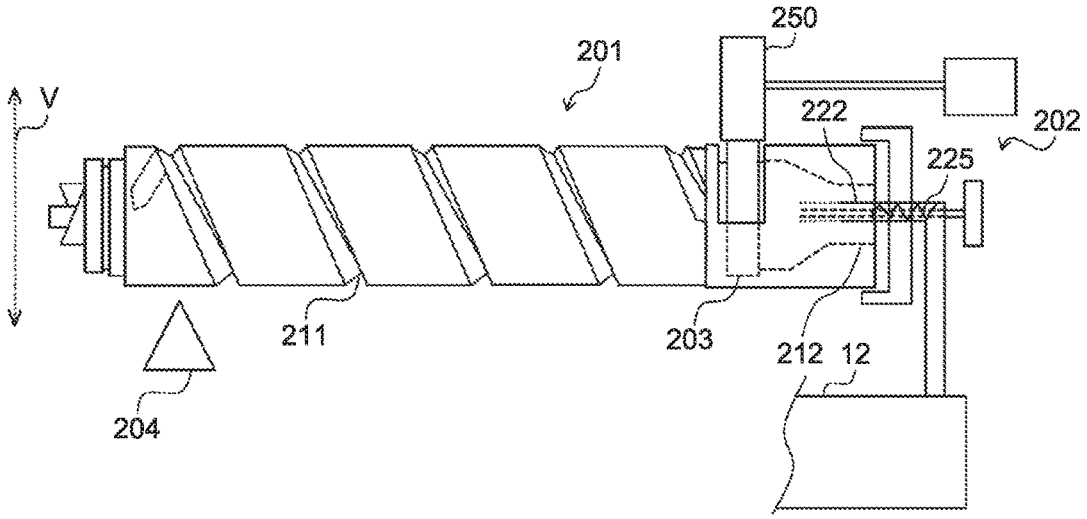
FIG. 4 is a view illustrating a configuration of the toner bottle according to the embodiment of the present invention.

Furthermore, as illustrated in FIG. 4, a gear 203 is formed on an outer periphery of the toner bottle 201, at one end in the longitudinal direction. When the toner bottle 201 is attached to a toner supply unit 202, a drive motor 250 provided at the toner supply unit 202 and the toner bottle 201 are joined together. When a bottle drive unit 121 is driven in this state, the drive motor 250 is rotated, and the toner bottle 201 is rotated about an axis in the longitudinal direction in accordance with the rotation of the drive motor 250.

Figure 3:
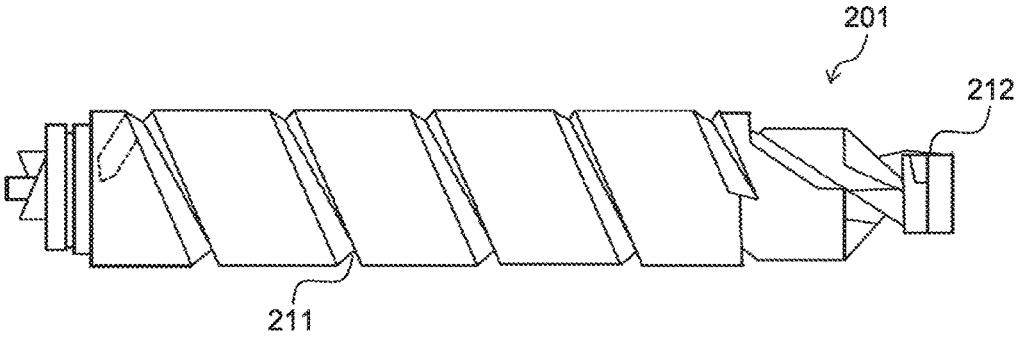
FIG. 3 is a view illustrating a configuration of a toner bottle according to the embodiment of the present invention.

Next, a configuration of the toner bottle 201, which is a powder container according to the present embodiment, will be described with reference to FIGS. 3 and 4. As illustrated in FIG. 3, the toner bottle 201 includes a protruding portion 211, and a supply port 212. The protruding portion 211 is provided helically along a longitudinal direction of the toner bottle 201. A protruding direction of the protruding portion 211 is toward an inner wall surface of the toner bottle 201, or in other words, a side where the toner is filled. That is, the protruding portion 211 is formed by causing the inner wall surface of the toner bottle 201 to protrude helically along the longitudinal direction. Additionally, an outer wall surface of the toner bottle 201 at a position where the protruding portion 211 is formed is recessed inward in accordance with the shape of the protruding portion 211.

Furthermore, as illustrated in FIG. 4, a gear 203 is formed on an outer periphery of the toner bottle 201, at one end in the longitudinal direction. When the toner bottle 201 is attached to a toner supply unit 202, a drive motor 250 provided at the toner supply unit 202 and the toner bottle 201 are joined together. When a bottle drive unit 121 is driven in this state, the drive motor 250 is rotated, and the toner bottle 201 is rotated about an axis in the longitudinal direction in accordance with the rotation of the drive motor 205.

When the toner bottle 201 is rotated, toner moves in the inside of the toner bottle 201 along the protruding portion 211, while being stirred by the protruding portion 211. As described above, the protruding portion 211 is formed helically along the longitudinal direction of the toner bottle 201, and thus, the toner also moves helically in the inside of the toner bottle 201.

Accordingly, the protruding portion 211 functions as a powder moving portion for moving the toner in such a way that a toner distribution in an inner space of the toner bottle 201 is changed. A description will be given below taking a rotation direction of the toner bottle 201 for moving the toner toward the supply port 212 as a supply direction, and a rotation direction of the toner bottle 201 for moving the toner away from the supply port 212 as a reverse direction.

Toner which is moved in the inside of the toner bottle 201 in the supply direction is sent to the developing device 12 by a conveying screw 225 inside a conveying nozzle 222 passing through an inside of the supply port 212. Toner is thus supplied from the toner bottle 201 to the developing device 12.

A strain sensor 204 is provided at a support portion supporting the toner bottle 201, on one end of the toner bottle 201 in the longitudinal direction, opposite from the supply port 212. In the present embodiment, a weight of the toner bottle 201 is measured based on an output value of the strain sensor 204, and the remaining amount of toner in the toner bottle 201 is detected based on the measured weight of the toner bottle 201.

Figure 5:
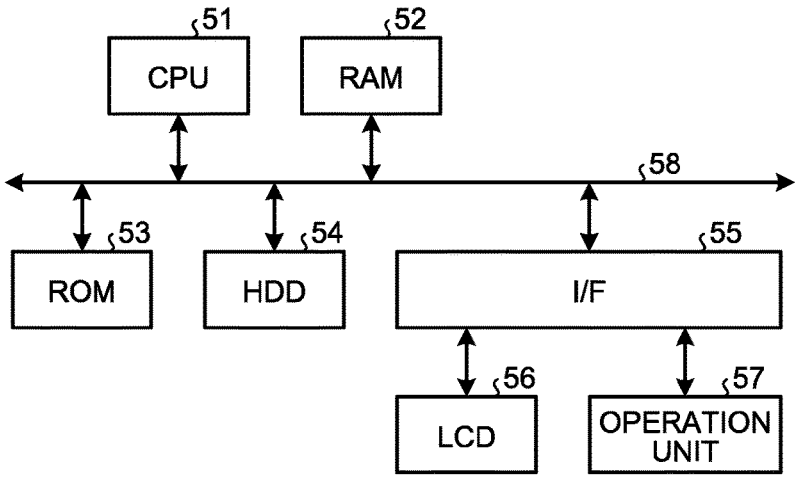
FIG. 5 is a hardware block diagram illustrating a hardware configuration of the image forming device according to the embodiment of the present invention.

Next, a hardware configuration of the image forming device 1 according to the present embodiment will be described with reference to FIG. 5. As illustrated in FIG. 5, with the image forming device 1 according to the present embodiment, a central processing unit (CPU) 51, a random access memory (RAM) 52, a read only memory (ROM) 53, a hard disk drive (HDD) 54, and an I/F 55 are connected by a bus 58. Moreover, a liquid crystal display (LCD) 56 and an operation unit 57 are connected to the I/F 55.

The CPU 51 is a calculation unit, and controls operation of the entire image forming device 1. The RAM 52 is a volatile storage medium allowing fast reading and writing of information, and is used as a working area at a time of the CPU 51 processing information. The ROM 53 is a read only non-volatile storage medium, and stores programs such as firmware. The HDD 54 is a non-volatile storage medium allowing reading and writing of information, and stores an operating system (OS), various control programs, application programs, and the like.

The I/F 55 connects the bus 58 and various types of hardware, a network and the like, and performs control. The LCD 56 is a visual user interface for a user to check the state of the image forming device 1. The operation unit 57 is a user interface, such as a keyboard and a mouse, used by a user to input information to the image forming device 1.

According to such a hardware configuration, a software control unit is configured by the CPU 51 performing calculation according to a program stored in the ROM 53 or a program loaded into the RAM 52 from a storage medium such as the HDD 54 or an optical disk. Functional blocks for realizing functions of the image forming device 1 according to the present embodiment are configured by a combination of the software control unit configured in the above manner and hardware.

Figure 6:
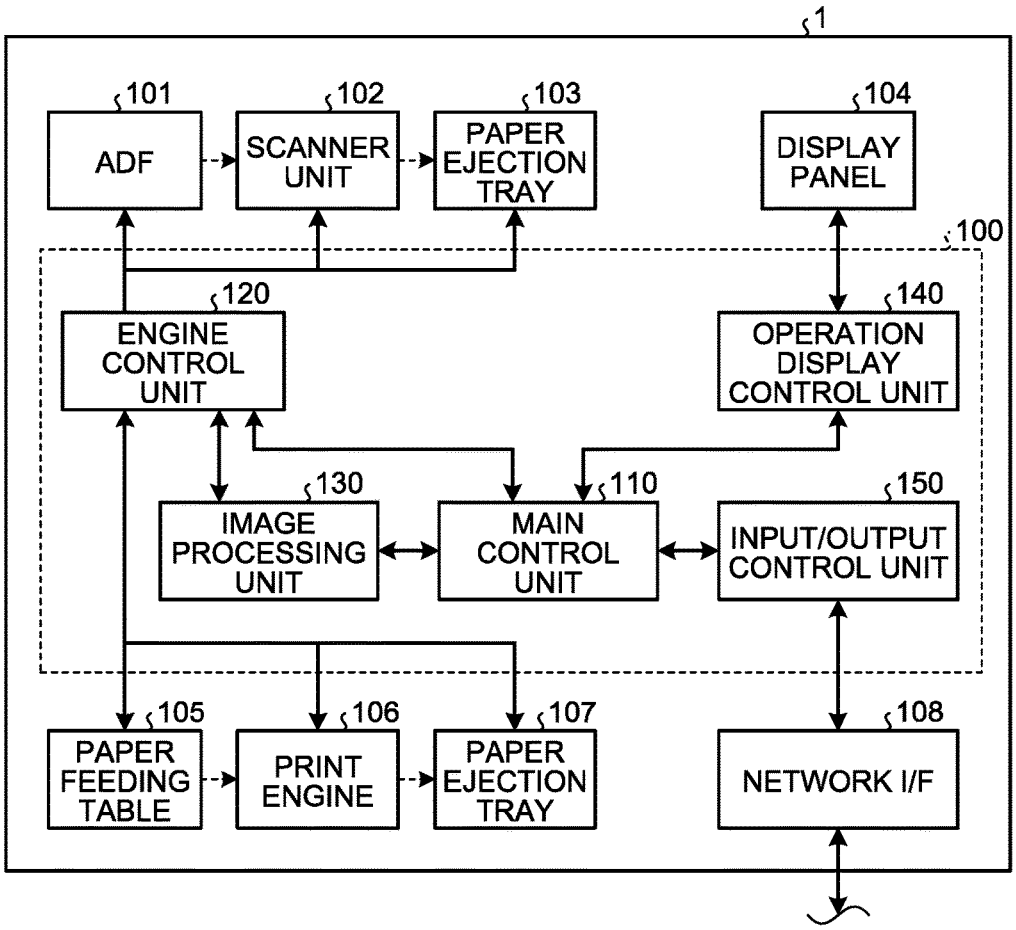
FIG. 6 is a functional block diagram illustrating a functional configuration of the image forming device according to the embodiment of the present invention.

Next, a functional configuration of the image forming device 1 according to the present embodiment will be described with reference to FIG. 6. As illustrated in FIG. 6, the image forming device 1 includes a controller 100, an auto document feeder (ADF) 101, the scanner unit 102, a paper ejection tray 103, the display panel 104, the paper feeding table 105, the print engine 106, the paper ejection tray 107, and a network I/F 108.

Moreover, the controller 100 includes a main control unit 110, an engine control unit 120, an image processing unit 130, an operation display control unit 140, and an input/output control unit 150. As illustrated in FIG. 6, the image forming device 1 is configured as a multifunction peripheral including the scanner unit 102, and the print engine 106. Additionally, in FIG. 6, an electrical connection is indicated by a solid-line arrow, and a flow of paper is indicated by a broken-line arrow.

The display panel 104 is a display unit for visually displaying the state of the image forming device 1, and is also an input unit which is used as a touch panel by a user to directly operate the image forming device 1 or to input information to the image forming device 1. That is, the display panel 104 has a function for displaying an image to receive an operation from a user. The display panel 104 is realized by the LCD 56 and the operation unit 57 illustrated in FIG. 5. Accordingly, the display panel 104 functions as an operation display unit.

The network I/F 108 is an interface for the image forming device 1 to communicate with another appliance over a network, and is an Ethernet (registered trademark) or universal serial bus (USB) interface. The network I/F 108 is capable of communication over a TCP/IP protocol. Moreover, when the image forming device 1 is to function as a facsimile, the network I/F 108 functions as an interface for executing facsimile transmission. For this purpose, the network I/F 108 is also connected to a telephone line. The network I/F 108 is realized by the I/F 55 illustrated in FIG. 5.

The controller 100 is configured by a combination of software and hardware. Specifically, the controller 100 is configured from the software control unit configured by the CPU 51 performing calculation according to a program which is stored in the ROM 53, a non-volatile memory, or a non-volatile storage medium, such as the HDD 54 or an optical disk, and which is loaded into a volatile memory (hereinafter "memory), such as the RAM 52, and hardware such as an integrated circuit. The controller 100 functions as a control unit for controlling the entire image forming device 1.

The main control unit 110 serves to control each unit included in the controller 100, and issues commands to each unit in the controller 100. The engine control unit 120 serves as a drive unit for controlling or driving the print engine 106, the scanner unit 102, and the like. The image processing unit 130 generates drawing information based on image information to be printed, under the control of the main control unit 110. The drawing information is information for drawing an image to be formed by the print engine 106, as an image forming unit, in an image forming operation.

Furthermore, the image processing unit 130 processes captured image data input from the scanner unit 102, and generates image data. The image data is information which is stored in a storage area of the image forming device 1 or transmitted to another information processing terminal or storage device via the network I/F 108 as a result of a scanning operation.

The operation display control unit 140 performs information display on the display panel 104, or notifies the main control unit 110 of information input via the display panel 104. The input/output control unit 150 inputs, to the main control unit 110, information which is input via the network I/F 108. Moreover, the main control unit 110 controls the input/output control unit 150, and accesses another appliance connected to a network, via the network I/F 108 and the network.

The operation display control unit 140 refers to arrangement information, in the HDD 54, which is information for displaying software keys on the display panel 104, and notifies the main control unit 110 of the arrangement information together with information input via the display panel 104.

In the case where the image forming device 1 operates as a printer, first, the input/output control unit 150 receives a print job via the network I/F 108. The input/output control unit 150 transfers the received print job to the main control unit 110. When the print job is received, the main control unit 110 controls the image processing unit 130 to generate drawing information (drawing data) based on document information or image information included in the print job.

When drawing information is generated by the image processing unit 130, the engine control unit 120 controls the print engine 106 such that image formation is performed on a sheet conveyed from the paper feeding table 105, based on the generated drawing information. That is, the image processing unit 130, the engine control unit 120, and the print engine 106 function as an image formation/output unit. A document after image formation by the print engine 106 is ejected to the paper ejection tray 107.

In the case where the image forming device 1 operates as a scanner, the operation display control unit 140 or the input/output control unit 150 transfers a scan execution signal to the main control unit 110, in response to operation of the display panel 104 by a user or a scan execution instruction input from another terminal via the network I/F 108. The main control unit 110 controls the engine control unit 120 based on the received scan execution signal.

The engine control unit 120 drives the ADF 101, and conveys an image capturing target document set in the ADF 101 to the scanner unit 102. Furthermore, the engine control unit 120 drives the scanner unit 102, and captures an image of the document conveyed from the ADF 101. Moreover, in the case where a document is not set in the ADF 101 but is directly set in the scanner unit 102, the scanner unit 102 captures an image of the set document under the control of the engine control unit 120. That is, the scanner unit 102 operates as an image capturing unit, and the engine control unit 120 functions as a reading control unit.

In an image capturing operation, an image sensor, such as a contact image sensor (CIS) or a charge-coupled device (CCD), included in the scanner unit 102 optically scans a document, and captured image information is generated based on optical information. The engine control unit 120 transfers the captured image information generated by the scanner unit 102 to the image processing unit 130. The image processing unit 130 generates image information based on the captured image information received from the engine control unit 120, under the control of the main control unit 110.

The image information generated by the image processing unit 130 is acquired by the main control unit 110, and is saved by the main control unit 110 in a storage medium, such as the HDD 54, mounted on the image forming device 1. That is, the scanner unit 102, the engine control unit 120, and the image processing unit 130 together function as an image input unit. The image information generated by the image processing unit 130 is stored in the HDD 54 or the like without change, or is transmitted to an external device via the input/output control unit 150 and the network I/F 108 according to an instruction from a user.

Furthermore, in the case where the image forming device 1 operates as a copier, the image processing unit 130 generates drawing information based on captured image information received by the engine control unit 120 from the scanner unit 102 or image information generated by the image processing unit 130. As in the case of the printer operation, the engine control unit 120 drives the print engine 106 based on the drawing information. Additionally, in the case where information formats of the drawing information and the captured image information are the same, the captured image information can be used as the drawing information without change.

With such a configuration, the image forming device 1 detects the remaining amount of toner in the toner bottle 201 based on an output value of the strain sensor 204. Next, a function, according to the present embodiment, for detecting the remaining amount of toner in the toner bottle 201 will be described with reference to FIGS. 7 and 8.

Figure 7:
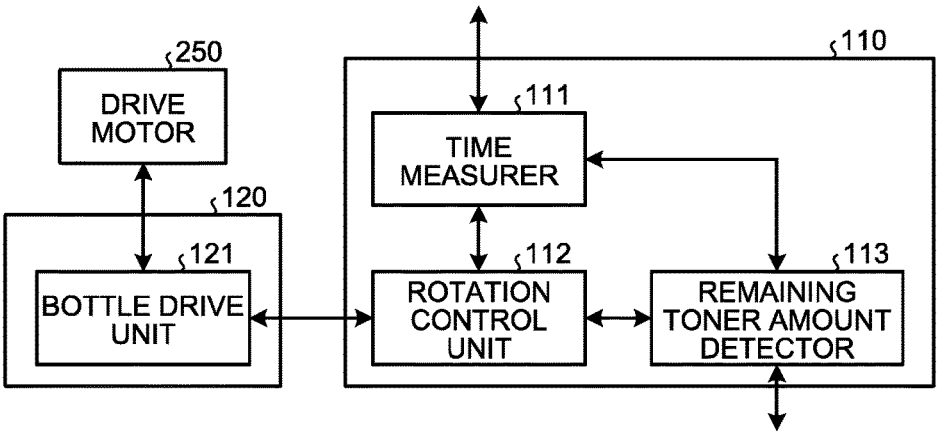
FIG. 7 is a functional block diagram illustrating a configuration of a function for detecting the remaining amount of toner according to the embodiment of the present invention.

FIG. 7 is a functional block diagram illustrating a function for detecting the remaining amount of toner in the toner bottle 201 according to the present embodiment. As illustrated in FIG. 7, in the present embodiment, the main control unit 110 and the engine control unit 120 detect the remaining amount of toner in the toner bottle 201 in coordination with each other.

As illustrated in FIG. 7, the main control unit 110 includes a time measurer 111, a rotation control unit 112, and a remaining toner amount detector 113. Furthermore, the engine control unit 120 includes the bottle drive unit 121. The time measurer 111 measures an elapsed time from a predetermined timing, according to an operation status of the image forming device 1.

The rotation control unit 112 transmits, to the bottle drive unit 121, command information for operating the drive motor 250. The bottle drive unit 121 drives the drive motor 250 to rotate the toner bottle 201. The remaining toner amount detector 113 is a remaining powder amount detector which detects the remaining amount of toner in the toner bottle 201 based on information, input to the main control unit 110, regarding operation of the image forming device 1.

Figure 8:
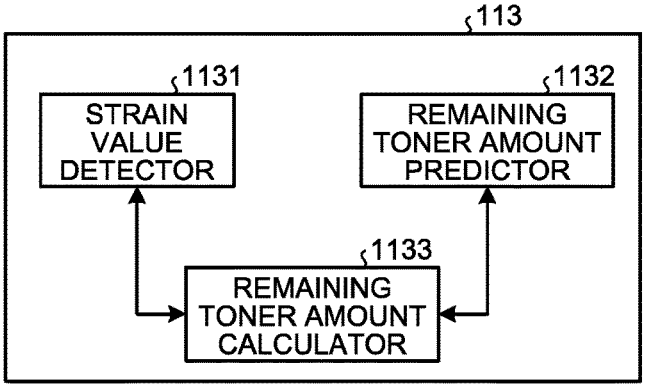
FIG. 8 is a functional block diagram illustrating a configuration of the function for detecting the remaining amount of toner according to the embodiment of the present invention.

In the following, an internal configuration of the remaining toner amount detector 113 will be described with reference to FIG. 8. The remaining toner amount detector 113 includes a strain value detector 1131, a remaining toner amount predictor 1132, and a remaining toner amount calculator 1133.

The strain value detector 1131 detects a value output by the strain sensor 204 (hereinafter, such a value will be referred to as "strain value") in response to a change in a position of the support portion supporting the toner bottle 201, according to the weight of the toner bottle 201, in a vertical direction, or in other words, a direction indicated by an arrow V in FIG. 4. Accordingly, the strain value detector 1131 functions as a change value detector for detecting the strain value, which is a change value indicating a positional change of the toner bottle 201.

The remaining toner amount predictor 1132 functions as a remaining powder amount predictor for calculating a prediction value of the remaining amount of toner in the toner bottle 201 based on the number of pixels of drawing information which is formed and output as an image at the image forming device 1. The remaining toner amount calculator 1133 has a data table indicating a relationship between the strain value and the remaining amount of toner or a mathematical expression indicating a relationship between the strain value and the remaining amount of toner, and calculates the remaining amount of toner in the toner bottle 201 based on the strain value.

Figure 9:
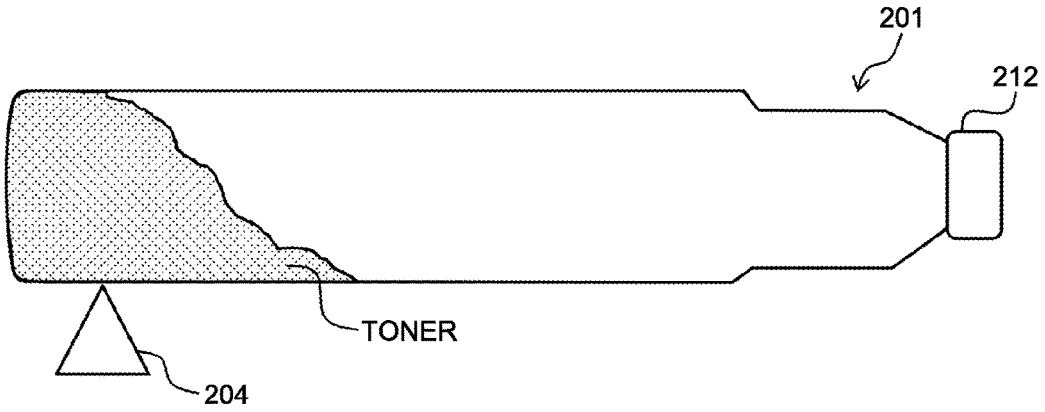
FIG. 9 is a view illustrating a distribution situation of toner according to the embodiment of the present invention.
Figure 10:
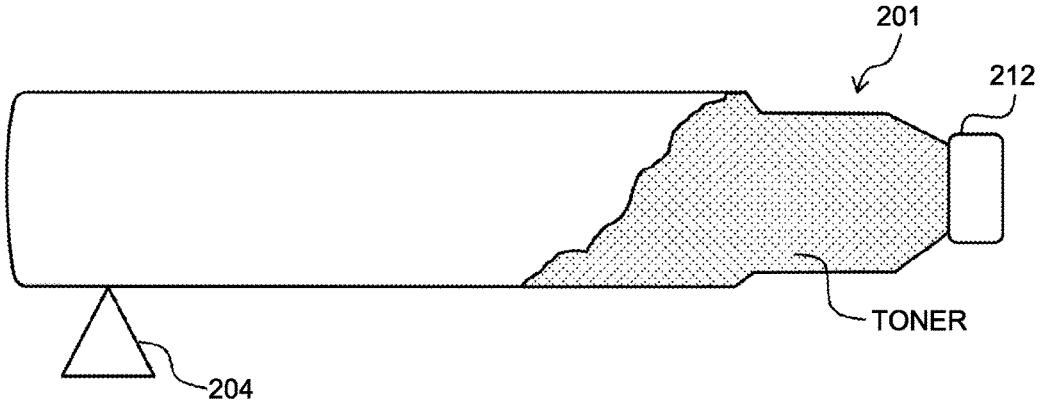
FIG. 10 is a view illustrating the distribution situation of the toner according to the embodiment of the present invention.
Figure 11:
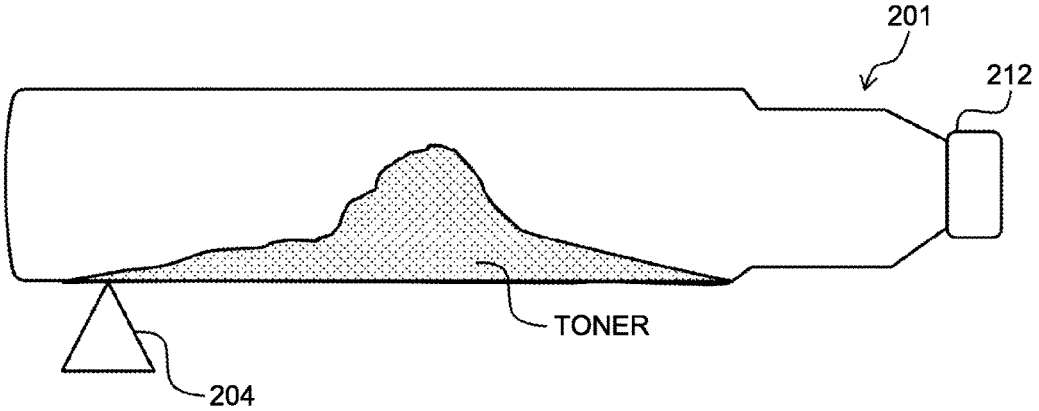
FIG. 11 is a view illustrating the distribution situation of the toner according to the embodiment of the present invention.

With such a configuration, the present embodiment rotates the toner bottle 201, and thereby controls a toner distribution in the toner bottle 201 and detects the remaining amount of toner. FIGS. 9 to 11 are views illustrating a distribution situation of toner in the toner bottle 201 according to the present embodiment. In FIGS. 9 to 11, toner is illustrated as a shaded region in the toner bottle 201.

In the toner bottle 201 illustrated in FIG. 9, toner is distributed near the strain sensor 204 concentratedly. In the toner bottle 201 illustrated in FIG. 10, toner is distributed near the supply port 212 concentratedly. In the toner bottle 201 illustrated in FIG. 11, toner is distributed around a center in the longitudinal direction of the toner bottle 201 concentratedly.

Toner inside the toner bottle 201 passes through the supply port 212, and is supplied to the developing device 12. Accordingly, immediately after the toner is supplied from the toner bottle 201 to the process cartridge 80, the toner is distributed near the supply port 212 concentratedly in the inside of the toner bottle 201, as illustrated in FIG. 10. This is because the toner moves along the protruding portion 211 in the direction of the supply port 212 when the toner bottle 201 is rotated.

Figure 12:
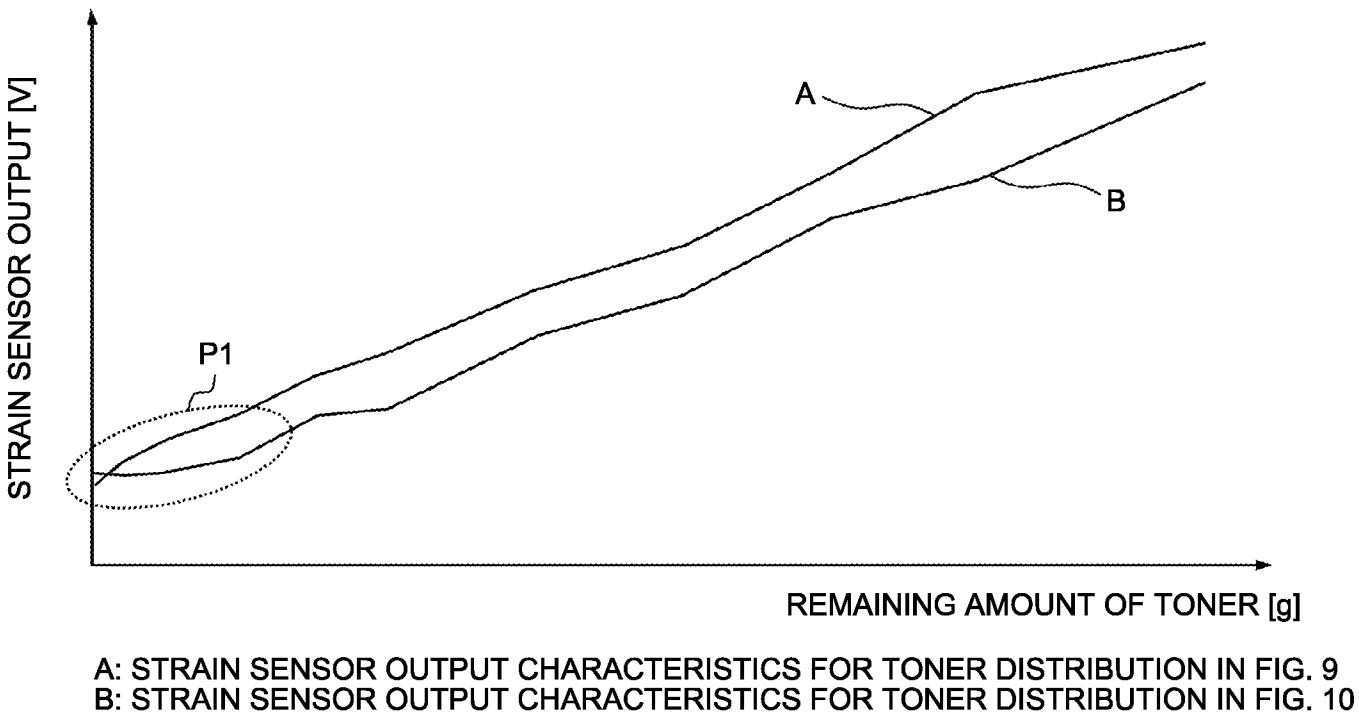
FIG. 12 is a graph describing an error occurring at the time of detection of the remaining amount of toner according to the embodiment of the present invention.

FIG. 12 is a graph describing an error occurring at the time of detection of the remaining amount of toner based on strain values for the toner distributions illustrated in FIGS. 9 and 10. In FIG. 12, output characteristics of the strain sensor 204 for the toner distribution in FIG. 9 are indicated by a curved line A, and output characteristics of the strain sensor 204 for the toner distribution in FIG. 10 are indicated by a curved line B.

In FIG. 12, a strain value detected by the strain sensor 204 when the remaining amount of toner in the toner bottle 201 is small is illustrated in a region P1. With the toner distribution in FIG. 9, the strain value is detected according to the remaining amount of toner, regardless of the remaining amount of toner in the toner bottle 201, and thus, the curved line A is a linearly curved line.

On the other hand, with the toner distribution in FIG. 10, in the case where the remaining amount of toner is small, an output value of the strain sensor 204 different from the strain value corresponding to the actual remaining amount of toner is detected, and thus, the curved line B is not a linearly curved line. Accordingly, in the state of the toner distribution in FIG. 10, the remaining amount of toner in the toner bottle 201 cannot be accurately detected.

Accordingly, in the present embodiment, at the time of detecting the remaining amount of toner in the toner bottle 201, the remaining amount of toner is detected after the toner is moved such that the toner is distributed near the strain sensor 204, as illustrated in FIG. 9. The toner which is distributed near the supply port 212 concentratedly, can be moved near the strain sensor 204 by rotating the toner bottle 201 in the reverse direction.

Figure 13:
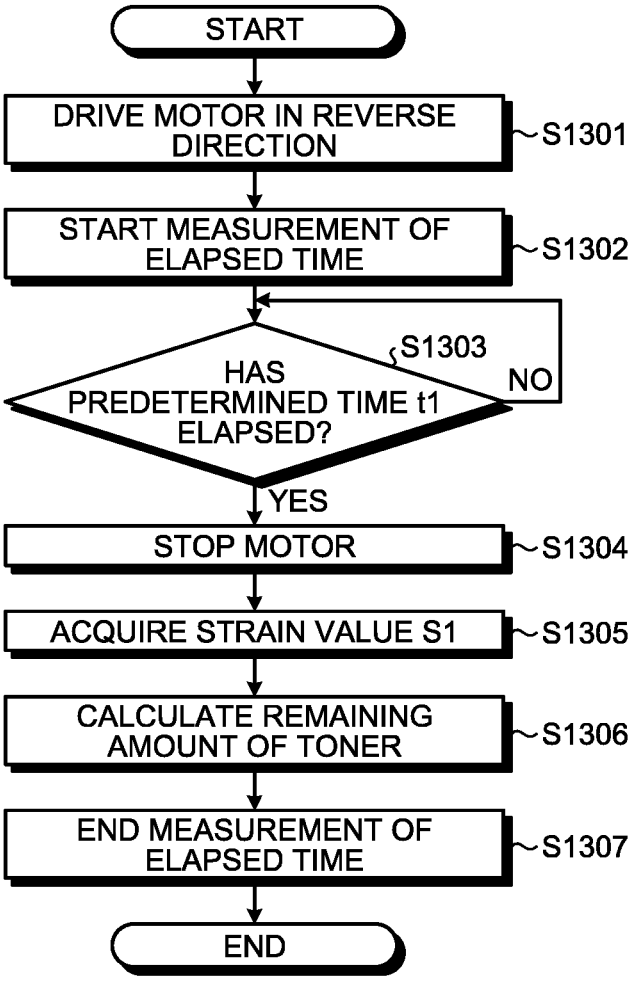
FIG. 13 is a flowchart illustrating a flow of processing for detecting the remaining amount of toner according to the embodiment of the present invention.

Next, a flow of processing for detecting the remaining amount of toner in the toner bottle 201 according to the present embodiment will be described with reference to FIG. 13. FIG. 13 is a flowchart illustrating a flow of processing for detecting the remaining amount of toner in the toner bottle 201 according to the present embodiment.

Additionally, the present processing is started, as a trigger, when toner is supplied from the toner bottle 201 to the developing device 12, after massive image formation/output is performed, when a user performs operation for detection of the remaining amount of toner using the display panel 104, or at an arbitrary cycle set in advance, for example.

The rotation control unit 112 transmits, to the bottle drive unit 121, command information for driving the drive motor 250 such that the toner bottle 201 is reversely rotated, and the bottle drive unit 121 drives the drive motor 250 according to the command information (S1301). The time measurer 111 starts measurement of an elapsed time from the timing when driving of the drive motor 250 is started (S1302). The time measurer 111 measures the time during which the drive motor 250 is driven such that the toner bottle 201 is rotated and the toner is moved.

Next, when the measured time of the time measurer 111 reaches a predetermined time t1 (S1303/Yes), the rotation control unit 112 transmits, to the bottle drive unit 121, command information for stopping driving of the drive motor 250. The bottle drive unit 121 stops the drive motor 250 according to the command information from the rotation control unit 112 (S1304).

Additionally, the time t1 is time necessary for the toner to move to near the strain sensor 204, and a data table indicating the value corresponding to the remaining amount of toner is stored in advance in the time measurer 111. In S1302, the time measurer 111 determines, based on the previous value of the remaining amount of toner, the predetermined time t1 corresponding to the time during which the toner moves in the toner bottle 201, and performs time measurement.

When the drive motor 250 stops, the strain value detector 1131 acquires a strain value S detected by the strain sensor 204 (S1305). The remaining toner amount calculator 1133 calculates the remaining amount of toner in the toner bottle 201 based on the strain value S acquired in S1305 (S1306).

The remaining toner amount calculator 1133 has a data table indicating a relationship between the strain value and the remaining amount of toner. Accordingly, in the process in S1306, the remaining toner amount calculator 1133 extracts, from the data table, the remaining amount of toner corresponding to the strain value S acquired in S1305.

When the remaining amount of toner is calculated by the remaining toner amount calculator 1133, the time measurer 111 ends time measurement (S1307), and the main control unit 110 ends the present processing. Additionally, when the remaining amount of toner in the toner bottle 201 calculated in S1306 is smaller than a predetermined amount, the main control unit 110 may perform a process of displaying a screen for giving notice to a user on the display panel 104.

As described above, in the present embodiment, to accurately detect the remaining amount of toner in the toner bottle 201, the strain value is acquired after the toner is moved to near the strain sensor 204, and the remaining amount of toner is calculated. Moreover, the toner may be moved to near the strain sensor 204 to calculate the remaining amount of toner while reducing the time during which the drive motor 250 is driven.

Figure 14:
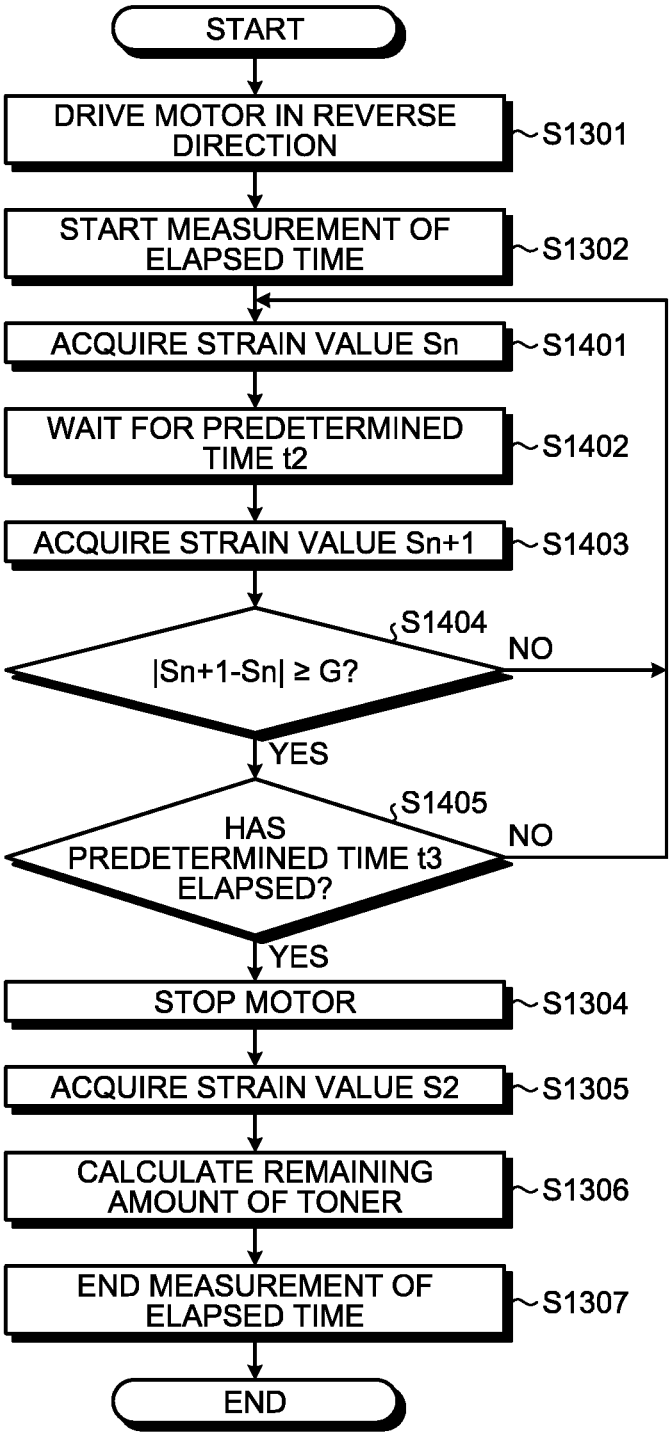
FIG. 14 is a flowchart illustrating a flow of processing for detecting the remaining amount of toner according to the embodiment of the present invention.

In the following, a flow of processing for detecting the remaining amount of toner while reducing the time during which the drive motor 250 is driven will be described with reference to FIG. 14. In the flowchart illustrated in FIG. 14, the same reference signs are assigned to processes that are the same as in FIG. 13, and redundant description is omitted.

When measurement of time during which the drive motor 250 is driven is started by the time measurer 111 (S1302), the strain value detector 1131 acquires a strain value Sn (S1401), it is confirmed, based on a measurement value of the time measurer 111, that a predetermined time t2 elapsed from S1401 (S1402), and then a strain value Sn+1 is acquired (S1403).

At this time, the strain value detector 1131 may detect the strain value several times over a time interval corresponding to the predetermined time t2.

At this time, time which is calculated based on the number of rotations and a rotational speed of the toner bottle 201 may be used as the time t2; for example, time necessary for the toner bottle 201 to rotate twice may be taken as t2.

When an absolute value of a difference between the strain value Sn and the strain value Sn+1 falls within a predetermined range (S1404/Yes), the rotation control unit 112 causes the time measurer 111 to start measurement of a predetermined time t3, and in a case where a state where the absolute value of the difference between the strain value Sn and the strain value Sn+1 stays within the predetermined range (S1404/Yes) continues for the predetermined time t3 (S1405/Yes), command information for stopping the drive motor 250 is transmitted to the bottle drive unit 121. The bottle drive unit 121 stops the drive motor 250 according to the received command information (S1404).

Accordingly, the rotation control unit 112 functions as a movement state determining unit for determining, based on a degree of change in the strain value, whether the toner moved to near the strain sensor 204, or in other words, a movement state of the toner.

Subsequent processes are the same as the processes of the flowchart illustrated in FIG. 13. Additionally, time corresponding to time during which the toner moves in the toner bottle 201 may be used as the time t3, based on the previous value of the remaining amount of toner.

On the other hand, in the case where the absolute value of the difference of between the strain value Sn and the strain value Sn+1 is outside the predetermined range (S1404/No), or in the case the predetermined time t3 is not elapsed (S1405/No), the rotation control unit 112 performs the processing from S1401.

In this manner, by controlling the time during which the toner bottle 201 is reversely rotated, based on the absolute value of the difference between the strain value Sn and the strain value Sn+1, the strain value when the toner in the toner bottle 201 is distributed near the strain sensor 204 can be reliably detected.

Figure 15:
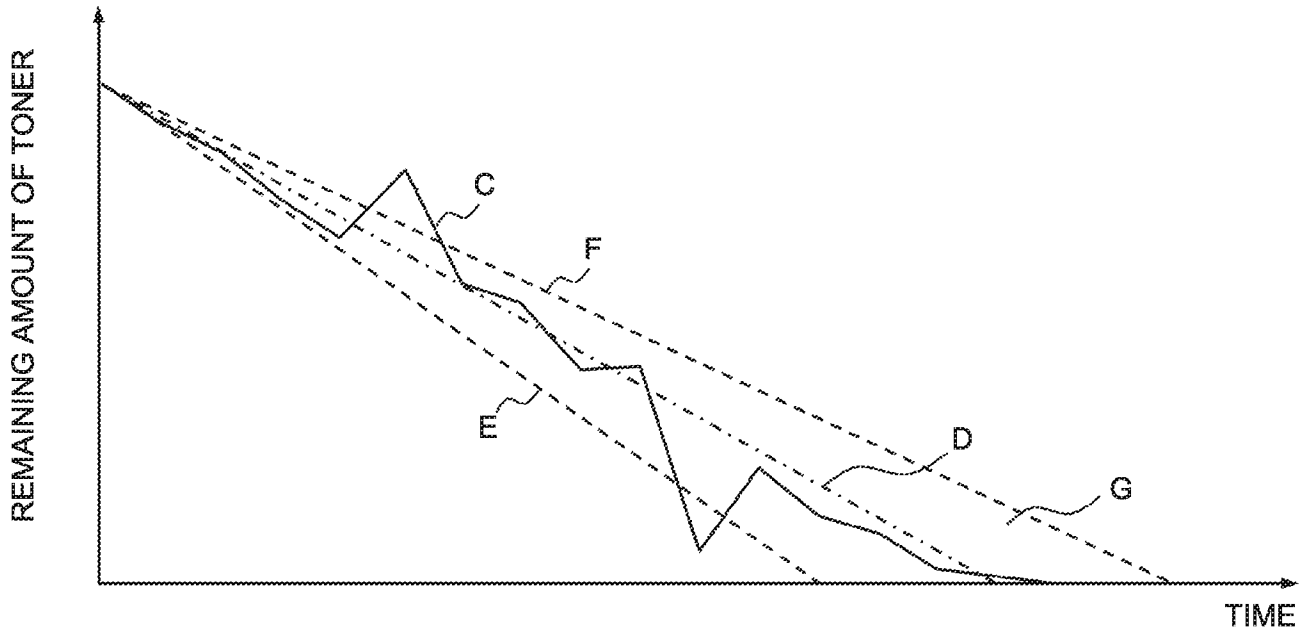
FIG. 15 is a graph describing an error occurring at the time of detection of the remaining amount of toner according to the embodiment of the present invention.

In the present embodiment, the toner in the toner bottle 201 is distributed near the strain sensor 204 concentratedly, and then, the strain value is detected to detect the remaining amount of toner in the toner bottle 201. However, as illustrated in FIG. 15, an error may occur in the strain value detected by the strain sensor 204, depending on an operation status of the image forming device 1.

Another image forming device calculates the remaining amount of toner based on the number of pixels of drawing information. In FIG. 15, a graph denoted by a reference sign D indicates tendency of change over time in the remaining amount of toner of the image forming device 1 predicted based on the number of pixels of drawing information, a graph denoted by a reference sign E indicates tendency of change over time in a minimum value of the remaining amount of toner of the image forming device 1 predicted based on the number of pixels of the drawing information, and a graph denoted by a reference sign F indicates tendency of change over time in a maximum value of the remaining amount of toner of the image forming device 1 predicted based on the number of pixels of the drawing information.

With the image forming device 1, even when performing printing using the same drawing information, the amount of consumption of toner varies depending on density of printing or the number of prints. Accordingly, in the present embodiment, it is determined whether the remaining amount of toner calculated based on the strain value is within a range from the maximum value to the minimum value of the remaining amount of toner predicted based on the number of pixels of drawing information printed by the image forming device 1 (hereinafter, such a range will be referred to as "predicted range"). Whether a strain value detected by the strain sensor 204 is an abnormal value is thereby detected, and the remaining amount of toner in the toner bottle 201 is detected with increased accuracy.

Figure 16:
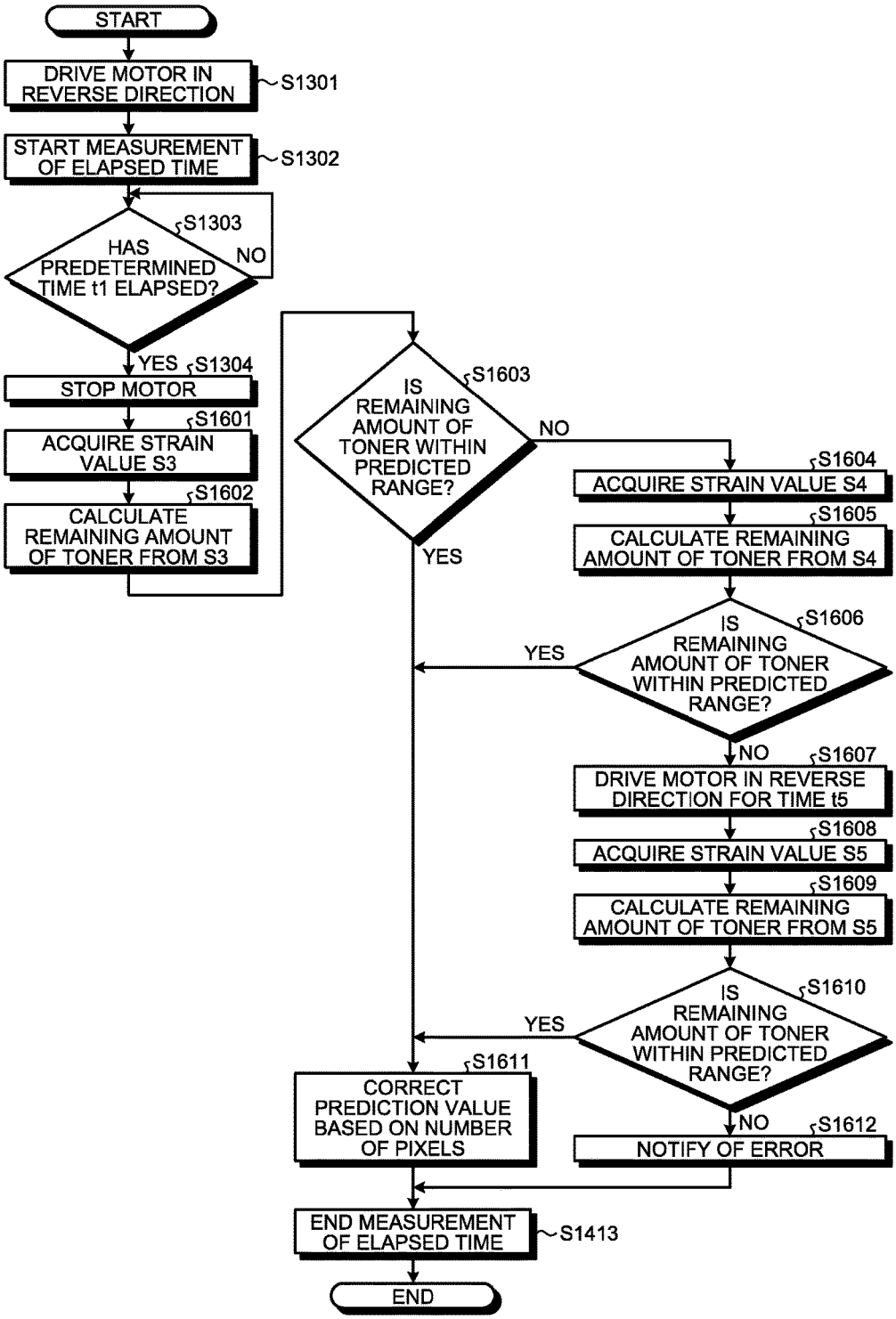
FIG. 16 is a flowchart illustrating a flow of processing for detecting the remaining amount of toner according to the embodiment of the present invention.

In the following, a description is given, with reference to FIG. 16, of a flow of processing for detecting the remaining amount of toner in the toner bottle 201 based on comparison between the remaining amount of toner calculated based on the strain value and a predicted range G of the remaining amount of toner determined based on the number of pixels of drawing information printed by the image forming device 1. In FIG. 16, the same reference signs are assigned to processes that are the same as in FIG. 13 or FIG. 14, and redundant description is omitted. That is, processes from S1301 to S1304 in the flowchart illustrated in FIG. 16 are the same as the processes which are described above using the same reference signs.

That is, the toner bottle 201 is reversely rotated for the predetermined time t1, and then, the drive motor 250 is stopped by the bottle drive unit 121 (S1301 to S1304). Then, the strain value detector 1131 acquires a strain value S3 by the strain sensor 204 (S1601).

The remaining toner amount calculator 1133 calculates the remaining amount of toner based on the strain value S3 (S1602). The remaining toner amount detector 113 determines whether the value of the remaining amount of toner calculated in S1602 falls within the predicted range G of the remaining amount of toner determined by the remaining toner amount predictor 1132 based on information such as the number of pixels of drawing information already printed by the image forming device 1, the number of prints, the density of printing, and/or the like (S1603).

In the case where the value of the remaining amount of toner calculated in S1602 is within the predicted range G of the remaining amount of toner determined based on the number of pixels of drawing information printed before S1601 (S1603/Yes), the remaining toner amount detector 113 replaces the remaining amount of toner determined by the remaining toner amount predictor 1132 with the value of the remaining amount of toner calculated in S1602 (S1611), and detects the value after replacement as the remaining amount of toner. The remaining toner amount predictor 1132 can thus predict the remaining amount of toner with increased accuracy.

In the case where the value of the remaining amount of toner calculated in S1602 is not within the predicted range G of the remaining amount of toner determined based on the number of pixels of drawing information printed before S1601 (S1603/No), the strain value detector 1131 detects a strain value S4 by the strain sensor 204 (S1604), and the remaining toner amount calculator 1133 calculates the remaining amount of toner based on the strain value S4 (S1605).

In the case where the value of the remaining amount of toner calculated in S1605 is within the predicted range G of the remaining amount of toner determined based on the number of pixels of drawing information printed before S1601 (S1606/Yes), the remaining toner amount detector 113 replaces the remaining amount of toner determined by the remaining toner amount predictor 1132 with the value of the remaining amount of toner calculated in S1605 (S1611), and detects the value after replacement as the remaining amount of toner.

In the case where the value of the remaining amount of toner calculated in S1605 is not within the predicted range G of the remaining amount of toner determined based on the number of pixels of drawing information printed before S1601 (S1606/No), the rotation control unit 112 performs controls of reversely rotating the toner bottle 201.

Specifically, the rotation control unit 112 transmits, to the bottle drive unit 121, command information for reversely rotating the toner bottle 201 for predetermined time t5, and the bottle drive unit 121 drives the drive motor 250 such that the toner bottle 201 is reversely rotated for the predetermined time t5 (S1607).

With respect to the predetermined time t5, time corresponding to the time during which the toner moves in the toner bottle 201 may be used as the time t5, based on the value of the remaining amount of toner calculated in S1605 and the predicted range G of the remaining amount of toner determined based on the number of pixels of drawing information.

When the toner bottle 201 is reversely rotated for the predetermined time t5, and the drive motor 250 is stopped, the strain value detector 1131 acquires a strain value S5 by the strain sensor 204 (S1608).

The remaining toner amount calculator 1133 calculates the remaining amount of toner based on the strain value S5 (S1609). In the case where the value of the remaining amount of toner calculated in S1609 is within the predicted range G of the remaining amount of toner determined based on the number of pixels of drawing information printed before S1601 (S1610/Yes), the remaining toner amount detector 113 performs correction of replacing the remaining amount of toner determined by the remaining toner amount predictor 1132 with the value of the remaining amount of toner calculated in S1609 (S1611), and detects the remaining amount of toner.

Additionally, in the process in S1611, the remaining toner amount detector 113 may save the value of the remaining amount of toner calculated in S1609 as a remaining toner amount correction value, without replacing the value of the remaining amount of toner determined by the remaining toner amount predictor 1132 with the value of the remaining amount of toner calculated in S1609. Moreover, detection of an abnormality of the strain sensor 204 may be performed, without performing the process in S1611.

In the case where the value of the remaining amount of toner calculated in S1609 is not within the predicted range G of the remaining amount of toner determined based on the number of pixels of drawing information printed before S1601 (S1610/No), the main control unit 110 determines that there is an abnormality in the strain sensor 204, and gives error notice indicating that an abnormality occurs (S1612). At this time, the main control unit 110 functions as an abnormality detector. Moreover, the main control unit 110 may display a notification screen on the display panel 104, for example, to give the error notice.

When the process in S1611 or S1612 is performed, the time measurer 111 ends measurement of time (S1613), and the main control unit 110 ends the present processing. Additionally, in the case where the remaining toner amount predictor 1132 has a data table for setting an arbitrary range according to the remaining amount of toner, a range of arbitrary values may be set as the predicted range G of the remaining amount of toner based on the previous value of the remaining amount of toner.

Furthermore, when the remaining amount of toner becomes smaller than a predetermined value, the remaining toner amount detector 113 may use, as the remaining amount of toner, an intermediate value in the predicted range G predicted by the remaining toner amount predictor 1132. Moreover, the main control unit 110 may use, as the remaining amount of toner, a value which is determined by the remaining toner amount predictor 1132 after error notification in S1612.

As described above, the image forming device according to the present embodiment includes a remaining powder amount detection device for controlling the distribution of toner in the toner bottle to be in a specific state to detect the remaining amount of toner, and detects the remaining amount of toner. The remaining amount of toner in the toner bottle can thereby be accurately detected, and moreover, whether or not there is an abnormality in the sensor for detecting the remaining amount of toner can be detected.

Figure 17:
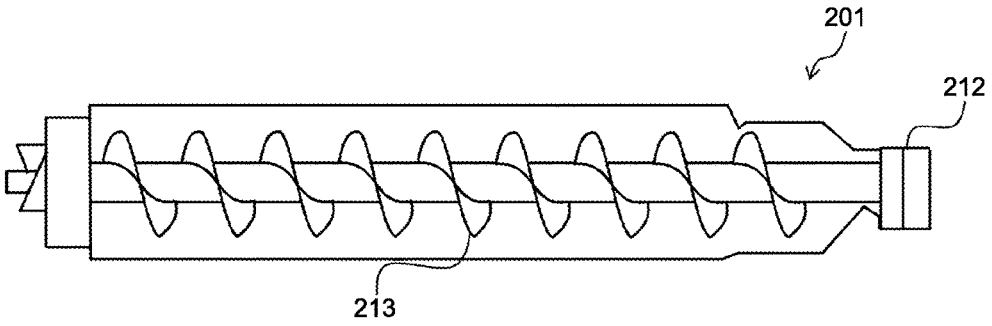
FIG. 17 is a view illustrating another configuration of the toner bottle according to the embodiment of the present invention.

Additionally, the toner bottle 201 of the present embodiment is described taking, as an example, a toner bottle including the protruding portion 211 on the inner wall surface, but the present invention can be applied to a toner bottle 201, as illustrated in FIG. 17, including a screw mechanism 213 in the inside, instead of the protruding portion 211.

When attached to the toner supply unit 202, the screw mechanism 213 engages with the drive motor 250, and is rotated according to driving of the drive motor 250. The distribution of toner in an inner space of the toner bottle 201 is changed by the rotation of the screw mechanism 213. Accordingly, the screw mechanism 213 functions as a powder moving portion which moves the toner in the toner bottle 201 to thereby change a distribution state, without rotation of the toner bottle 201.

According to an embodiment, the remaining amount of powder in a container can be accurately detected.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A remaining powder amount detection device comprising:

a powder moving portion configured to change a distribution of powder in an inner space of a powder container containing the powder, the powder container including a supply port through which the powder is supplied toward an outside of the powder container, the supply port disposed at an end of the powder container in a longitudinal direction of the powder container;

a strain detector disposed at an other end of the powder container opposite from the supply port, the strain detector configured to detect a change value indicating a positional change of the powder container; and processing circuitry configured to drive the powder moving portion to rotate in a second direction that is reverse to a first direction being a rotation direction for moving the powder toward the supply port in the powder container, detect, after performing the rotation in the second direction for a predetermined time period, a change value indicating a positional change of the powder container, and detect a remaining amount of the powder contained in the powder container, based on the change value.

2. The remaining powder amount detection device according to claim 1, wherein the processing circuitry is configured to determine a movement state of the powder based on a degree of change in the change value detected at a predetermined time interval.

3. The remaining powder amount detection device according to claim 1, wherein the powder moving portion is a protruding portion that protrudes from an inner wall of the powder container, the protruding portion formed in a helical shape extending in the longitudinal direction of the powder container.

4. The remaining powder amount detection device according to claim 1, wherein the powder moving portion is a screw mechanism that is disposed at the inner space of the powder container, the screw mechanism extending in the longitudinal direction of the powder container.

5. An image forming device configured to perform development by powder as a developer to perform image formation/output based on drawing information to be formed and output as an image, the device comprising:

a powder moving portion configured to change a distribution of the powder in an inner space of a powder container containing the powder, the powder container including a supply port through which the powder is supplied toward an outside of the powder container, the supply port disposed at an end of the powder container in a longitudinal direction of the powder container;

a strain detector disposed at an other end of the powder container opposite from the supply port, the strain detector configured to detect a change value indicating a positional change of the powder container; and processing circuitry configured to drive the powder moving portion to rotate in a second direction that is reverse to a first direction being a rotation direction for moving the powder toward the supply port in the powder container;

detect, after performing the rotation in the second direction for a predetermined time, a change value indicating a positional change of the powder container, and detect a remaining amount of the powder contained in the powder container, based on the change value.

6. The image forming device according to claim 5, wherein the processing circuitry is configured to calculate a prediction value of the remaining amount based on a number of pixels of the drawing information and an operation status of the image forming device, and detect occurrence of an abnormality in the strain detector based on a predicted range that is a range between a maximum and a minimum of the prediction value, and the change value.

7. The image forming device according to claim 6, wherein the processing circuitry is configured to detect the remaining amount based on the change value in a case where the change value within the predicted range is detected.

8. The image forming device according to claim 6, wherein the processing circuitry is configured to correct the prediction value based on the change value, and detect the remaining amount in a case where the change value within the predicted range is detected.

9. The image forming device according to claim 6, wherein the processing circuitry is configured to determine that an abnormality occurs in the strain detector, in a case the change value outside the predicted range is detected a predetermined number of times.

10. The image forming device according to claim 5, wherein the processing circuitry is configured to detect the remaining amount after the image formation/output is performed.

11. The image forming device according to claim 5, wherein the powder moving portion is a protruding portion that protrudes from an inner wall of the powder container, the protruding portion formed in a helical shape extending in the longitudinal direction of the powder container.

12. The image forming device according to claim 5, wherein the powder moving portion is a screw mechanism that is disposed at the inner space of the powder container, the screw mechanism extending in the longitudinal direction of the powder container.

13. A remaining powder amount detection method that is for detecting a remaining amount of powder as a developer in an image forming device configured to perform development by the powder to perform image formation/output based on drawing information to be formed and output as an image, the method comprising:

driving a powder moving portion to rotate in a second direction being reverse to a first direction, the powder moving portion being provided for changing a distribution of the powder in an inner space of a powder container containing the powder the first direction being a rotation direction for moving the powder toward a supply port in the powder container through which the powder is supplied toward an outside of the powder container;

detecting, with a strain detector after performing the rotation in the second direction for a predetermined time period, a change value indicating a positional change of the powder container, the strain detector disposed at an end of the powder container opposite from the supply port;

detecting the remaining amount of the powder contained in the powder container based on the change value.

* * * * *